US005682013A

United States Patent [19]

Smith et al.

[11] Patent Number: 5,682,013

[45] Date of Patent: Oct. 28, 1997

[54] GAS GENERANT BODY HAVING PRESSED-ON BURN INHIBITOR LAYER

[75] Inventors: Bradley W. Smith, Ogden; Scott C. Mitson, Honeyville, both of Utah

[73] Assignee: Morton International, Inc., Chicago, Ill.

[21] Appl. No.: 466,030

[22] Filed: Jun. 6, 1995

Related U.S. Application Data

[63] Continuation of Ser. No. 934,830, Aug. 24, 1992, abandoned.

[51] Int. Cl.[6] ..... C06B 45/32

[52] U.S. Cl. ..... 149/6; 149/5; 149/14; 149/35; 102/290; 280/741

[58] Field of Search ..... 149/5, 6, 14, 35; 102/290; 280/741

[56] References Cited

U.S. PATENT DOCUMENTS

| | | | |
|---|---|---|---|
| 1,074,809 | 10/1913 | Newton | 102/286 |
| 1,108,437 | 8/1914 | Hibbard | 149/5 |
| 1,308,343 | 7/1919 | DuPont | 102/290 |
| 2,407,151 | 9/1946 | Glogau | 149/5 |
| 3,144,870 | 8/1964 | de Fries | 102/290 |
| 3,158,109 | 11/1964 | Stott | 107/17 |
| 3,396,661 | 8/1968 | Michael | 102/103 |
| 3,493,446 | 2/1970 | Braun et al. | 149/109 |
| 3,724,870 | 4/1973 | Kurokawa et al. | 280/741 |
| 3,741,585 | 6/1973 | Hendrickson et al. | 149/35 |
| 3,895,098 | 7/1975 | Pietz | 149/35 |
| 3,895,821 | 7/1975 | Schotthoefer | 280/741 |
| 3,901,530 | 8/1975 | Radke | 280/150 AB |
| 3,901,747 | 8/1975 | Garner | 149/42 |
| 3,914,851 | 10/1975 | Sauer et al. | 264/3 |
| 3,931,040 | 1/1976 | Breazeale | 149/35 |
| 3,985,375 | 10/1976 | Lewis et al. | 280/741 |
| 4,005,876 | 2/1977 | Jorgensen et al. | 280/741 |
| 4,009,231 | 2/1977 | Wasserman et al. | 102/290 |
| 4,062,708 | 12/1977 | Goetz | 149/35 |
| 4,092,186 | 5/1978 | Gordon et al. | 102/290 |
| 4,131,300 | 12/1978 | Radke et al. | 280/741 |
| 4,200,615 | 4/1980 | Hamilton et al. | 280/741 |
| 4,203,787 | 5/1980 | Kirchoff et al. | 149/35 |
| 4,244,758 | 1/1981 | Garner et al. | 149/35 |
| 4,246,051 | 1/1981 | Garner et al. | 149/7 |
| 4,296,084 | 10/1981 | Adams et al. | 423/351 |
| 4,547,342 | 10/1985 | Adams et al. | 280/741 |
| 4,552,070 | 11/1985 | Langer | 102/290 |
| 4,590,860 | 5/1986 | Kromley | 102/290 |
| 4,696,705 | 9/1987 | Hamilton | 149/35 |
| 4,698,107 | 10/1987 | Goetz et al. | 149/35 |
| 4,806,180 | 2/1989 | Goetz et al. | 149/5 |
| 4,817,828 | 4/1989 | Goetz | 280/736 |
| 4,833,992 | 5/1989 | Gellerstedt et al. | 102/290 |
| 4,890,860 | 1/1990 | Schneiter | 280/741 |
| 4,931,112 | 6/1990 | Wardle et al. | 149/88 |
| 4,998,751 | 3/1991 | Paxton et al. | 280/741 |

(List continued on next page.)

FOREIGN PATENT DOCUMENTS

| | | | |
|---|---|---|---|
| 39 33 554 | 11/1990 | Germany | C06O 5/00 |

*Primary Examiner*—Edward A. Miller

*Attorney, Agent, or Firm*—Charles N. Lovell; Gerald K. White

[57] ABSTRACT

A pyrotechnic grain or body of a gas generant having a consolidated or pressed-on, particulate inert burn inhibitor layer thereon. The inhibitor may be a metal oxide, metal sulfide, silica, silicate compound or mixtures thereof. The metal oxide is preferably iron oxide. The metal sulfide is preferably molybdenum disulfide. The preferred inhibitor is a silicate compound, most preferably bentonite. The inhibitor layer most preferably covers only one face or side of the generant body, though it may cover both faces or less than the entire area of one or both faces. The generant may be any conventional formulation which generates nitrogen-containing gas, preferably an azide, and most preferably sodium azide. The generant body may be any shape, preferably a washer-shaped disc. An automotive gas bag inflator may contain a plurality of the composite, inhibited generant bodies, preferably a stack or side by side assembly of such composite, inhibited wafers.

18 Claims, 2 Drawing Sheets

U.S. PATENT DOCUMENTS

| | | | |
|---|---|---|---|
| 5,000,885 | 3/1991 | Laird et al. | 102/290 |
| 5,015,309 | 5/1991 | Wardle et al. | 149/19.1 |
| 5,024,160 | 6/1991 | Canterberry et al. | 102/290 |
| 5,034,070 | 7/1991 | Goetz et al. | 149/5 |
| 5,051,143 | 9/1991 | Goetz | 149/5 |
| 5,345,873 | 9/1994 | Lauritzen et al. | 102/290 |
| 5,507,890 | 4/1996 | Swann et al. | 149/14 |

GAS GENERANT BODY HAVING PRESSED-ON BURN INHIBITOR LAYER

CROSS REFERENCE TO COPENDING RELATED APPLICATIONS

This is a continuation of application Ser. No. 07/934,830 filed on Aug. 24, 1992, now abandoned.

BACKGROUND OF THE INVENTION

1. Field of the Invention

The present invention pertains to a pyrotechnic grain or body made of a conventional gas generant or propellant formulation, preferably an azide-based composition, and having a pressed-on, granular ignition or burn inhibitor layer thereon. The inhibited generant body or composite is especially designed for use in the combustion chamber of a gas generator or inflator which produces a gas upon combustion which, after typically filtering out condensed phase products, is preferably used to inflate a gas bag which serves as a vehicle occupant restraint cushion during a collision. More particularly this invention relates to a generant body having pressed-on, consolidated powder inhibitor layer(s) thereon comprising inert materials such as metal oxides (preferably iron oxide), metal sulfides (preferably molybdenum disulfide), silica, silicate compounds (preferably bentonite) or mixtures thereof.

Even though the generant bodies of this invention are especially designed and suited for creating gas for inflating passive restraint vehicle crash bags, as indicated, they would be useful in other less severe inflation applications, such as aircraft slides, inflatable boats and inflatable lifesaving buoy devices, and would more generally find utility any place a low temperature, non-toxic gas is needed, such as for a variety of pressurization and purging applications as, for example, in fuel and oxidizer tanks in rocket motors.

2. Description of the Prior Art

Automobile gas bag systems have been developed to protect the occupant of a vehicle, in the event of a collision, by rapidly inflating a cushion or bag between the vehicle occupant and the interior of the vehicle. The inflated gas bag absorbs the occupant's energy to provide a gradual, controlled deceleration, and provides a cushion to distribute body loads and keep the occupant from impacting the hard surfaces of the vehicle interior.

The use of such protective gas-inflated bags to cushion vehicle occupants in crash situations is now widely known and well documented.

The requirements of a gas generant suitable for use in an automobile gas bag device are very demanding. The generant must have a burning rate such that the gas bag is inflated rapidly (within approximately 30 to 100 milliseconds). The burning rate must not vary with long term storage (aging) or as a result of shock and vibration during normal deployment. The burning rate must also be relatively insensitive to changes in humidity and temperature. When pressed into pellets, wafers, cylinders, discs or whatever shape, the hardness and mechanical strength of the bodies must be adequate to withstand the mechanical environment to which they may be exposed over the expected inflator system lifetime of at least ten years without any fragmentation or change of exposed surface area. Excessive breakage of the bodies could potentially lead to system failure where, for example, an undesirable high pressure condition might be created within the gas generator device, possibly resulting in rupture of the pressure housing.

The gas generant must efficiently produce relatively cool, non-toxic, non-corrosive gas which is easily filtered to remove solid and liquid combustion by-products, and thus preclude damage to the inflatable bag or to the occupant of the automobile.

The requirements as discussed in the preceding paragraphs limit the applicability of many otherwise suitable compositions, shapes and configurations thereof from being used in automotive air bag gas generators.

Both azide and non-azide generant formulations which generate nitrogen-containing or nitrogen-rich gas to expand an inflatable occupant restraint are well known. Azide-based gas generants include, for example, at least one alkali or alkaline earth metal azide as the base fuel constituent. See, for example U.S. Pat. Nos. 3,741,585; 3,895,098; 3,931,040; 4,062,708, 4,203,787, and 5,143,567 application Ser. No. 07/749,032 (MI 2105-21-00) filed Aug. 23, 1991. Typical non-azide generants are disclosed in commonly assigned U.S. Pat. Nos. 4,931,112, 5,015,309, 5,160,386 and 5,197,758, and additional art cited therein. Particulate ingredients of such generant compositions are typically mixed and consolidated, with or without a suitable binder and other auxiliary ingredients, by press molding into tablets, wafers, etc., as is conventional. When the generant bodies are ignited and burned, nitrogen-containing gas is produced which, after filtering, is used to inflate the gas bag.

It has been proposed in U.S. Pat. Nos. 3,901,530 and 4,131,300 to form the pyrotechnic combustible material for inflators in the form of separate discs arranged side by side with inert separator means disposed between adjacent discs to facilitate quick and uniform combustion of the material as well as achieving slower inflation onset.

Inflators such as shown in commonly assigned U.S. Pat. Nos. 4,005,876; 4,296,084 and 4,547,342 contain generant in the form of pressed pellets or tablets (similar in shape to aspirin tablets) which are randomly packed into the inflator combustion chamber. More recently it has been proposed in commonly assigned U.S. Pat. Nos. 4,890,860 and 4,998,751 to fabricate an inflator grain by assembling a plurality of washer-shaped generant wafers or discs in alternating relationship with a plurality of similarly shaped, meshed inert cushion members which are held in compression in the inflator combustion chamber to achieve improved performance. While such arrangements may be satisfactory for some purposes, the generant bodies in general present a high initial surface area for burning and thus do not provide as soft of an inflation onset as is desired.

It has also been proposed to provide gas bag inflator wafers or grains with a combustion booster or enhancer coatings. See, for example, U.S. Pat. Nos. 4,200,615; 4,244,758; 4,246,051; 4,696,705; 4,698,107; 4,806,180; 4,817,828; 5,034,070 and 5,051,143. The chief purpose of these booster or enhancer coatings is to speed up, rather than inhibit or slow down, the onset of generant combustion. Moreover, many of these enhancer coatings contain long chain organic compounds, e.g. fluoroelastomers, which when ignited produce some carbon monoxide which is an undesirable ingredient in the propellant gas.

It is also known that inhibitor or restrictor, i.e. slower burning, coatings have been applied to (1) ammunition or firearm type base propellants, as illustrated in U.S. Pat. Nos. 1,074,809; 1,308,343; 3,194,851 and 3,396,661 and (2) solid rocket motor propellant grains, as illustrated in U.S. Pat. Nos. 3,493,446 and 5,000,885.

OBJECTS AND SUMMARY OF THE INVENTION

An object of the present invention is to provide a generant body for use in a gas bag inflator which has a configuration that can be inhibited to restrict or retard the combustion of a portion of the base generant for a predetermined time period.

Another related object of the present invention is to provide a generant body which will have a dual gas output rate wherein the initial burn is at a low rate of gas output followed by a higher rate of gas output.

Another related object of the present invention is to provide gas bag generant bodies so configured that on combustion a delay in bag onset will occur thereby improving the loading on the gas bag components as well as lessening "out-of-position" occupant concerns during bag deployment, particularly on the passenger side of an automobile.

As set forth in greater detail below, the above objectives of the present invention have been achieved by configuring each propellant or gas generant body making up the inflator grain to have a pressed-on, particulate (powder) layer comprising a relatively inert, burn inhibitor or deterrent selected from the group consisting of a metal oxide, metal sulfide, silica, silicate compound and mixtures thereof. The preferred metal oxide is an iron oxide, preferably ferric oxide. The preferred metal sulfide is molybdenum disulfide. The preferred silicate compound is bentonite. Bentonite is also the most preferred inhibitor.

Though the inhibitor layer according to the invention may substantially cover one or both faces or sides of a generant body (inhibitor completely covering one wafer face being most preferred), it may also cover less than the entire expanse or face of the generant body, e.g. a continuous annular layer on the outer, intermediate or inner periphery of a disc-shaped wafer.

The generant body on which the compacted burn inhibitor is bonded may be any conventional azide or non-azide based generant formulation, preferably an azide, and most preferably sodium azide.

The overall composited, inhibited generant body may take any of the aforementioned conventional pellet, tablet, wafer, etc. forms, most preferably a washer-shaped disc.

Another important feature relates to a stack or side by side assembly of a plurality of the composite generant bodies according to the present invention.

Another important feature pertains to a method of generating nitrogen-containing or nitrogen-rich gas by igniting the composite generant bodies according to the present invention.

Another important feature deals with a conventional gas generator, for example, an automotive gas bag inflator, containing a plurality of the composite generant bodies according to the present invention, preferably one having a stack or side by side assembly of the generant bodies.

The above and other objectives, advantages and features of this invention will be apparent in the following detailed descriptions of the preferred embodiments thereof which is to be read in conjunction with the accompanying drawings.

DETAILED DESCRIPTION OF THE INVENTION

In some inflatable gas bag restraint applications, it is desirable to have an inflation system and procedure which demonstrates a dual gas output rate effect; that is, one which starts with a low rate of gas output during the first about 5 to 25 milliseconds, followed by a higher rate of gas output for the remainder of the inflation cycle whereby the loading on the gas bag system components are reduced as well as lessening the potential for harmful effects on an occupant (e.g. a small child) that is "out of position" (i.e. not properly positioned in the path of a deploying gas bag).

Figure 1:
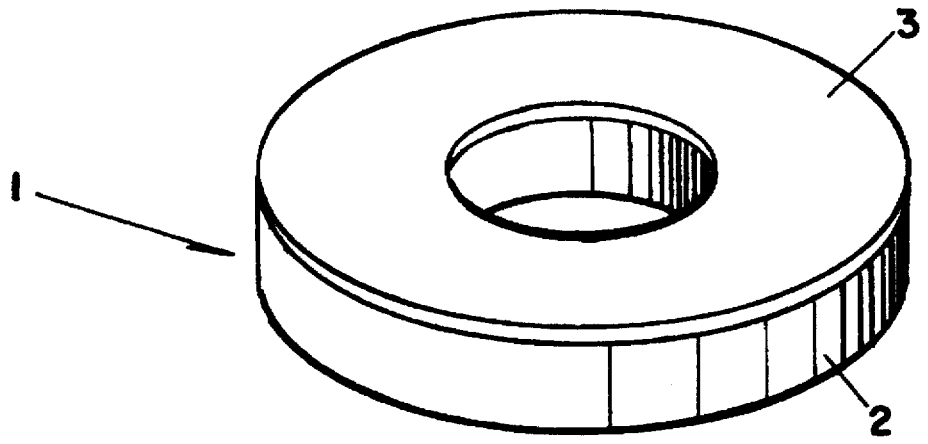
FIG. 1 is a space view of a washer-shaped generant wafer disc having a burn rate inhibitor layer on one face.
Figure 2:
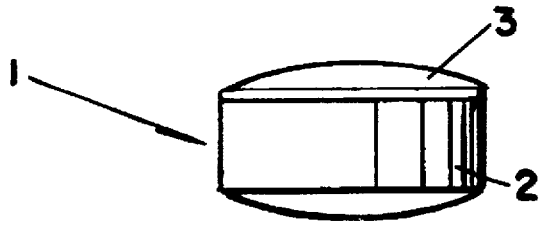
FIG. 2 is a space view of a pellet or tablet shaped generant body having a burn rate inhibitor layer on one face.

FIGS. 1 and 2 show two exemplary embodiments according to the invention of composite bodies 1 each having a main gas generant or propellant body part 2 and a burn inhibitor or restrictor layer 3 thereon whereby the above objectives are realized.

The composition of part 2 of the composite bodies 1 is not critical; thus any known generant, for example, any azide or non-azide based fuel formulation can be used, especially those used for automotive gas bag inflators meeting such well known requirements as burning rate, non-toxicity and flame temperature. The generant is preferably an azide-based fuel which produces a nitrogen-containing or nitrogen-rich gas, more preferably an alkali metal azide, and most preferably sodium azide. Exemplary azide-based generant compositions are disclosed in aforementioned U.S. patents, preferably formulations containing sodium azide, iron oxide, molybdenum disulfide and optionally sulfur according to aforementioned U.S. Pat. No. 4,203,787; compositions containing sodium azide, iron oxide, sodium nitrate, silica, alumina and optionally bentonite according to aforementioned U.S. Pat. No. 5,143,567 or most preferably formulations containing sodium azide, molybdenum disulfide and sulfur according to aforementioned U.S. Pat. No. 3,741,585. Exemplary non-azide based formulations are disclosed in aforementioned U.S. Pat. Nos. 4,931,112; 5,015,309; 5,160,386 and 5,197,758.

Part 3 of the composite bodies 1 is a pressed-on (consolidated), granular or powder made of such relatively inert burn inhibitor or deterrent materials as metal oxides, metal sulfides, silica, silicate compounds or mixtures thereof. An oxide of iron, most preferably ferric oxide, is the preferred metal oxide inhibitor, although other metal oxides (including complexes), such as alumina and titania may be used. Although other natural, refined or synthetic silica and silicate compounds (hydrous and anhydrous) may be used, bentonite is most preferred. The silica may be fumed or unfumed. Montmorillonite, atapulgite, kaolinite, illite, halloysite, pyrophyllite and talc are examples of other silicate compounds. Bentonite is also the most preferred inhibitor overall. Bentonite is a montmorillonite-containing clay or mineral which is a high silica-containing hydrous aluminum silicate compound having the approximate formula:

$$(Al, Fe_{1.67}Mg_{0.33})\ Si_4O_{10}(OH)_2\ (Na,Ca_{0.33})$$

The crux of the present invention centers on the composition of the burn inhibitor, as above described, together with the characteristics and properties imparted to the generant due to the configuration and manner in which the inhibitor layer(s) is applied or combined with the baseline generant body. During the combustion process the inhibiting layer burns and/or attrites away progressively exposing additional surface of baseline generant underneath. This newly exposed generant burning surface proportionally increases the rate of gas output creating the desired dual rate effect. The timing of the rate change is a function of the rate of loss or erosion of the inhibitor. Also by varying the thickness of the baseline generant of each wafer (and consequently the weight thereof) a steeper or shallower pressure slope angle and a shorter or longer burnout time may be obtained.

Figure 3:
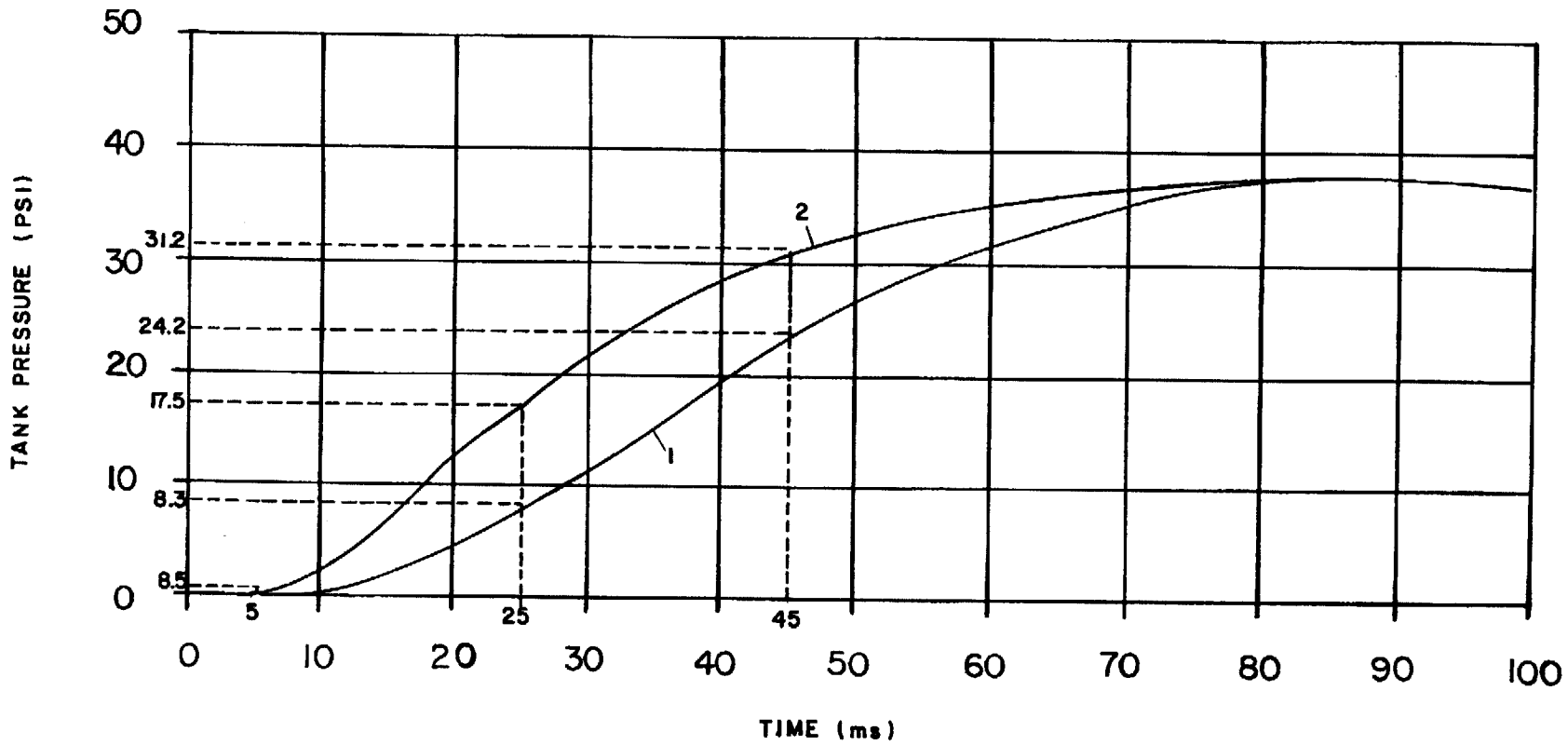
FIG. 3 is an S-curve graph showing the dual rate effect of inhibited generant bodies as compared to uninhibited generant bodies.

The dual rate effect is graphically illustrated by the exemplary curves shown in FIG. 3 wherein Tank Pressure (psi) versus Time (milliseconds) data is plotted for two sets of test samples. The tests were carried out in a 100 liter closed tank using inflators with and without inhibited wafers. The inflators were 253 mm long passenger inflators each using thirty-four 8.0 gram wafers. S-curve 1 represents a series of data points for a mass of burn inhibited generant waters (similar to the wafer of FIG. 1) in accordance with the invention. The inhibited wafers each had 0.4 grams of bentonite pressed on one side. Comparative S-curve 2 represents a series of data points for a mass of uninhibited control or standard wafers. The baseline generant used for both type wafers tested was about 68% $NaN_3$, 30% $MoS_2$ and 2% S (all percents by weight).

As demonstrated in FIG. 3 the overall objectives of reducing the initial pressure slope (i.e. during the first about 5–25 ms) and increasing the subsequent pressure slope (i.e. during the next about 25–45 ms), while maintaining the same approximate time to reach burnout or maximum pressure (i.e. about 80–90 ms), were achieved. This is quantitatively shown in the chart below by comparing pressure slope readings at 5, 25 and 45 ms for inhibited wafer curve 1 and control wafer curve 2 as shown in the dotted lines of FIG. 3:

| WAFERS (CURVES) | INITIAL SLOPE [pounds per sq. inch (psi)] / [milliseconds (ms)] | SUBSEQUENT SLOPE (psi) / (ms) | TIME TO MAX. PRESSURE (ms) |
|---|---|---|---|
| Control Wafers (Curve 2) | $\frac{(17.5-0.5)psi}{(25-5)ms}=0.85$ | $\frac{(31.2-17.5)psi}{(45-25)ms}=0.32$ | 83 |
| Inhibited wafers (Curve 1) | $\frac{(8.3-0.0)psi}{(25-5)ms}=0.42$ | $\frac{(24.2-8.3)psi}{(45-25)ms}=0.80$ | 87 |

Consequently the burn of the inhibited generant wafers is suppressed during the first about 5–25 ms by approximately 50% (0.85–0.42/0.85) as compared to the uninhibited or control wafers.

The composite generant body 1 preferably has a wafer shape, more preferably a cylinder or disc, and most preferably a washer-shaped disc as shown in FIG. 1. To particularly illustrate, the outside diameter of disc 1 as shown in FIG. 1 may vary from about 1.375 to about 1.500 inches, the inside diameter (i.e. diameter of opening) may vary from about 0.400 to about 0.562 inches, the thickness of body 2 may vary from about 0.100 to about 0.280 inches, and the thickness of the inhibitor layer 3 may vary from about 0.010 to about 0.025 inches. A somewhat less preferred generant body form is a pellet or tablet (similar in shape to an aspirin tablet) as depicted in FIG. 2. To particularly illustrate, the outside diameter of pellet or tablet 1 as shown in FIG. 2 may vary from about 0.250 to about 0.375 inches, the thickness of body 2 may vary from about 0.070 to about 0.280 inches and the thickness of the inhibitor layer 3 may vary from about 0.010 to about 0.025 inches. However, the overall shape of the gas generant body 1 is not critical and can be virtually any shape such as elliptical, rectangular (preferably a square) or the like. Although central holes or openings as shown in FIG. 1 are preferred in the wafer disc design, such openings may be omitted for certain applications, e.g. a solid multi-wafer grain as is known in the art. The shape of the opening in the wafer is not critical and may take a variety of shapes, such as elliptical, triangular, rectangular, etc., even though circular openings as shown in FIG. 1 are preferred. The shape of the opening is typically governed by the shape of the igniter chamber (which is normally circular) on which the wafers are preferably arranged. Also the perimeter wall of the generant composite 1, as well as the inner wall defining the opening as shown in FIG. 1, may have a saw-tooth or serrated design so as to increase the generant surface area presented for combustion, facilitate grain assembly, etc.

Although, as previously indicated, the potential utility of such generant bodies may be quite varied, according to the invention the preferred application is to form the generant mass in conventional inflators or gas generators therefrom, most preferably the type utilized in the combustion chamber of a conventional automotive gas bag crash protection restraint system. Although a plurality of the composite generant bodies 1 of the invention (e.g. the pellet or tablet of FIG. 2) may be randomly packed into an inflator combustion chamber (e.g. as shown in aforementioned U.S. Pat. Nos. 4,005,876 and 4,547,342), the preferred configuration and arrangement comprises a plurality of side by side (or stack of) composite wafer-shaped bodies (e.g. the washer-shaped disc of FIG. 1) having alternating inert spacer screens or discs forming a generant grain or array (e.g. as illustrated in aforementioned U.S. Pat. Nos. 4,890,860 and 4,998,751). These documents also show the well known basic component parts of such exemplary gas bag inflators; namely, a combustion chamber with a gas outlet, a generant mass or grain disposed within the combustion chamber, an igniter for the generant and gas passage means for routing gas generated to the gas outlet from the chamber, which gas is typically filtered to remove condensed phase combustion products. When the generant in these systems is ignited and burned, nitrogen-containing gas is produced which is used to inflate the gas bag.

Though, as indicated above, the generant body 1 may be a core layer having granular burn inhibitor pressed and bonded to both sides or faces, a two layer composite as depicted in FIGS. 1 and 2 is preferred, i.e. a generant base 2 having an inhibitor layer 3 on and substantially covering one side only. Also, though less preferred, less than the entire face of one or both sides of the generant base layer 2 may have inhibitor material compacted thereon, for example, an annular band or pad of inhibitor on either the outer, inner or intermediate the periphery of a wafer disc such as shown in FIG. 1. In addition, the inhibitor layer on one or both sides of the generant 2, may consist of a series of equally spaced, raised projections or pads which, for example, may have the configuration as disclosed in commonly assigned copending application Ser. No. 07/848,903 (MI 2146-21-00) filed Mar. 10, 1992, now abandoned.

The generant tablets, wafers, etc. are typically formed by hydraulically or mechanically consolidating or pressing requisite amounts of the granular or particulate generant composition in a suitably designed die system (e.g. stainless steel punch and die), as is conventional in the art. Such press molding procedures are easily modified to make the multilayer or composite inhibited generant bodies 1 according to the invention. For example, after the requisite amount of the particulate generant composition is pressed (preferably only partially consolidated), then the requisite amount of the granular inhibitor material is added on top of the pressed (partially) generant and a second pressing operation is performed which fully consolidates the two layers into a bonded composite (similar in shape to a DI-GEL® antacid tablet, particularly the FIG. 2 composite). Also the order of addition of the materials compacted may be reversed, i.e. the inhibitor may precede the generant. Also according to the invention a three-layer composite with inhibitor on both faces or sides of the generant core may be fabricated by modifying the latter procedure so that a second batch of granular inhibitor is added to the pre-compressed two layers, followed by a third compaction which fully consolidates the three layers. A less preferred technique may be utilized wherein a preformed generant body has granular inhibitor material compacted and bonded on one or both faces by similar press molding equipment and procedures as above described. The preformed generant body utilized in the less preferred composite fabrication scheme above described is preferably a powder compact of any suitable generant composition, most preferably a partially compacted ("green"), self-sustaining body having a density somewhat less than the optimum density of the finally compacted composite. An even less preferred technique would be to make the generant preform, for example, by an extrusion operation wherein a plasticized granular mixture, e.g. an azide-based generant formulation including the requisite amount of a suitable binder (as above described), or particularly a non-azide formulation chosen from those above described. The resulting generant extrudate could be any size and shape, but preferably a cylinder or tube, which could then be separated or divided, for example, by transversely severing to form the preformed tablets or wafer discs (as shown in FIGS. 1 and 2) of the desired thickness, which tablets or discs would then preferably be used while in a "green" and slightly compressible state as a preform on which the granular burn inhibitor would be pressed or compacted on one or both sides, as above described. Conversely, the inhibitor layer could be similarly preformed and composited with the generant in granular form or as a preform according to any of the schemes above described. However, due to the relative thinness of the inhibitor layer(s) and attendant problems of cracking and breaking in handling, using the inhibitor as a preform is the least preferred fabrication option. The particular manner in which the pressed-on inhibitor layer(s) is composited with the generant layer is not particularly critical as long as the requisite final generant composite has sufficient strength to withstand the rigors involved in the preferred automotive gas bag inflator utility and demonstrates the requisite burn rate characteristics, as above described.

If necessary, conventional binders (such as polypropylene carbonate (PPC), magnesium and calcium stearates, molybdenum disulfide, bentonite or similar hydrated high-silica clays or mixtures thereof), may be added to either or both of the particulate generant formulation and inhibitor material being consolidated and bonded, for example, as a pressing aid and to facilitate achieving the requisite bond strength of each layer and the composite as a whole. For example, a small amount (typically about 1–6 wt.%) of $MoS_2$ and/or bentonite may be added as a binder and compaction aid, for example, to granular iron oxide or other metal oxide inhibitor. In which case the $MoS_2$ and/or bentonite would serve the dual function of binder and inhibitor.

With this description of the invention in detail, those skilled in the art will appreciate that various modifications may be made to the invention without departing from the spirit thereof. Therefore it is not intended that the scope of the invention be limited to the specific embodiments illustrated and described. Rather it is intended that the invention scope be determined by the appended claims and their equivalents.

We claim:

1. A gas generant composite made from a body of gas generant formulation suitable for creating a gas for inflating a passive restraint vehicle crash bag said body being configured to have a plurality of sides or faces and having a pressed-on consolidated powder relatively inert burn inhibitor layer bonded to at least one face or side thereof consisting essentially of molybdenum disulfide and at least one material selected from the group consisting of a oxide, silica and silicate compound.

2. A gas generant body according to claim 1 wherein the inhibitor is selected from the group consisting of iron oxide, molybdenum disulfide, bentonite and mixtures thereof.

3. A gas generant body according to claim 2 wherein the inhibitor is bentonite.

4. A gas generant body according to claim 3 wherein the body consists essentially of an alkali metal azide based composition.

5. A gas generant body according to claim 4 wherein the alkali metal is sodium.

6. A gas generant body according to claim 5 having the shape of a pellet or tablet.

7. A gas generant body according to claim 5 having the shape of a wafer.

8. A gas generant body according to claim 7 wherein the wafer is a washer-shaped disc.

9. A side by side assembly of a plurality of gas generant discs as defined in claim 8.

10. A gas generant body according to claim 1 wherein the body consists essentially of a metal azide based composition.

11. A gas generant body according to claim 10 wherein the metal azide based composition is an alkali metal azide based composition.

12. A gas generant body according to claim 11 wherein the alkali metal is sodium.

13. A gas generant body according to claim 12 wherein the inhibitor is bentonite.

14. A gas generant body according to claim 13 having the shape of a pellet or tablet.

15. A gas generant body according to claim 13 having the shape of a wafer.

16. A gas generant body according to claim 15 wherein the wafer is a washer-shaped disc.

17. A side by side assembly of a plurality of gas generant discs as defined in claim 16.

18. A gas generant body according to claim 1 wherein the inhibitor substantially covers only one face or side of the body.

* * * * *